US007810588B2

(12) United States Patent
McClain et al.

(10) Patent No.: US 7,810,588 B2
(45) Date of Patent: Oct. 12, 2010

(54) MULTI-LAYER ENCAPSULATION OF DIAMOND GRIT FOR USE IN EARTH-BORING BITS

(75) Inventors: Eric E. McClain, Spring, TX (US); Dan E. Scott, Montgomery, TX (US); Wesley Dean Fuller, Willis, TX (US); Robert M. Welch, The Woodlands, TX (US); Jimmy W. Eason, The Woodlands, TX (US); Marcus R. Skeem, Sandy, UT (US); Van J. Brackin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 714 days.

(21) Appl. No.: 11/678,304

(22) Filed: Feb. 23, 2007

(65) Prior Publication Data

US 2008/0202821 A1 Aug. 28, 2008

(51) Int. Cl.
*B21K 5/04* (2006.01)

(52) U.S. Cl. ..... 175/434; 76/108.1; 76/108.4; 51/295

(58) Field of Classification Search ..... 175/425, 175/426, 434; 76/108.1, 108.2, 108.4; 51/295, 51/298

See application file for complete search history.

(56) References Cited

U.S. PATENT DOCUMENTS

| | | | |
|---|---|---|---|
| 3,841,852 | A | 10/1974 | Wilder et al. |
| 3,871,840 | A | 3/1975 | Wilder et al. |
| 4,943,488 | A | 7/1990 | Sung et al. |
| 5,024,680 | A | 6/1991 | Chen et al. |
| 5,049,164 | A | 9/1991 | Horton et al. |
| 5,062,865 | A | 11/1991 | Chen et al. |
| 5,106,392 | A | 4/1992 | Slutz et al. |
| 5,126,207 | A | 6/1992 | Chen et al. |
| 5,143,523 | A | 9/1992 | Matarrese |
| 5,224,969 | A | 7/1993 | Chen et al. |
| 5,405,573 | A | 4/1995 | Clark et al. |
| 6,238,280 | B1 | 5/2001 | Ritt et al. |
| 6,241,036 | B1 | 6/2001 | Lovato et al. |
| 2006/0081402 | A1 | 4/2006 | Lockwood et al. |

FOREIGN PATENT DOCUMENTS

| | | |
|---|---|---|
| EP | 0012 631 A | 6/1980 |
| FR | 762175 | 3/1971 |

OTHER PUBLICATIONS

New Diamond TECH2000 Hardfacing Increases Life and Improves Performance of PSF/MPSF Premium Steel Tooth Bits, three pages.

*Primary Examiner*—Daniel P Stephenson
(74) *Attorney, Agent, or Firm*—Bracewell & Giuliani LLP

(57) ABSTRACT

A method of constructing an earth-boring, diamond-impregnated drill bit has a first step of coating diamond grit with tungsten to create tungsten-coated diamond particles. These coated particles are then encapsulated in a layer of carbide powder held by an organic green binder material. The encapsulated granules are then mixed along with a matrix material and placed in a mold. The matrix material includes a matrix binder and abrasive particles. The mixture is heated in the mold at atmospheric pressure to cause the matrix binder to melt and infiltrate the encapsulated granules and abrasive particles.

13 Claims, 3 Drawing Sheets

MULTI-LAYER ENCAPSULATION OF DIAMOND GRIT FOR USE IN EARTH-BORING BITS

FIELD OF THE INVENTION

This invention relates in general to earth-boring bits, and in particular to a matrix diamond-impregnated bit.

BACKGROUND OF THE INVENTION

One type of drill bit employed for very abrasive drilling, such as hard sandstone, is known as a diamond-impregnated bit. Typically, this bit has a solid head or crown that is cast in a mold. The crown is attached to a steel shank that has a threaded end for attachment to the drill string. The crown may have a variety of configurations and generally includes post and blade-like members formed in the mold. Channels separate the blades for drilling fluid flow.

One type of manufacturing method for such a bit is known as a high-temperature, long-cycle infiltrating process. A mold is constructed in the shape of the crown of the bit. Diamond particles or grit and a matrix material are mixed and distributed into the mold. The diamond particles in one prior art process have a tungsten coating. One method for coating the diamond particles with tungsten in the prior art technique is a chemical vapor deposition (CVD) process. The matrix material includes a binder metal, typically a copper alloy, and hard abrasive particles such as tungsten carbide.

The matrix material and tungsten-coated diamond particles are heated in the mold for a time and temperature sufficient for the matrix binder metal to melt and infiltrate through the hard particles and diamond particles. After cooling, the binder bonds the diamonds and the hard abrasive particles. While this method and the resulting bit work well, the diamond particles have a tendency to agglomerate together, leaving a greater density of diamonds in some areas than in other areas. In some cases, the diamonds may be touching each other rather than being uniformly dispersed, as desired.

SUMMARY OF THE INVENTION

In this invention, the diamond particles are initially coated with tungsten to create coated particles. This process is performed conventionally, such as by a CVD process. Then, an encapsulation layer is applied to the coated particles to create encapsulated granules. The material of the encapsulated layer may be a carbide, such as tungsten carbide powder, that is applied mechanically as by a rolling process.

The encapsulated particles are mixed with a matrix material and placed in a mold. The matrix material will include a binder metal and may additionally include hard abrasive particles, such as tungsten carbide. Then, the mold is heated to a temperature high enough to cause the binder metal to melt and infiltrate around and into the encapsulated diamond granules. The binder metal will infiltrate through the carbide powder of the encapsulation layer into contact with the tungsten coating on the diamond crystal. The material of the encapsulation layer does not melt during this process, thus maintains a standoff between the diamond particles. The heating is preferably performed at atmospheric pressure.

DETAILED DESCRIPTION OF THE INVENTION

Figure 1:
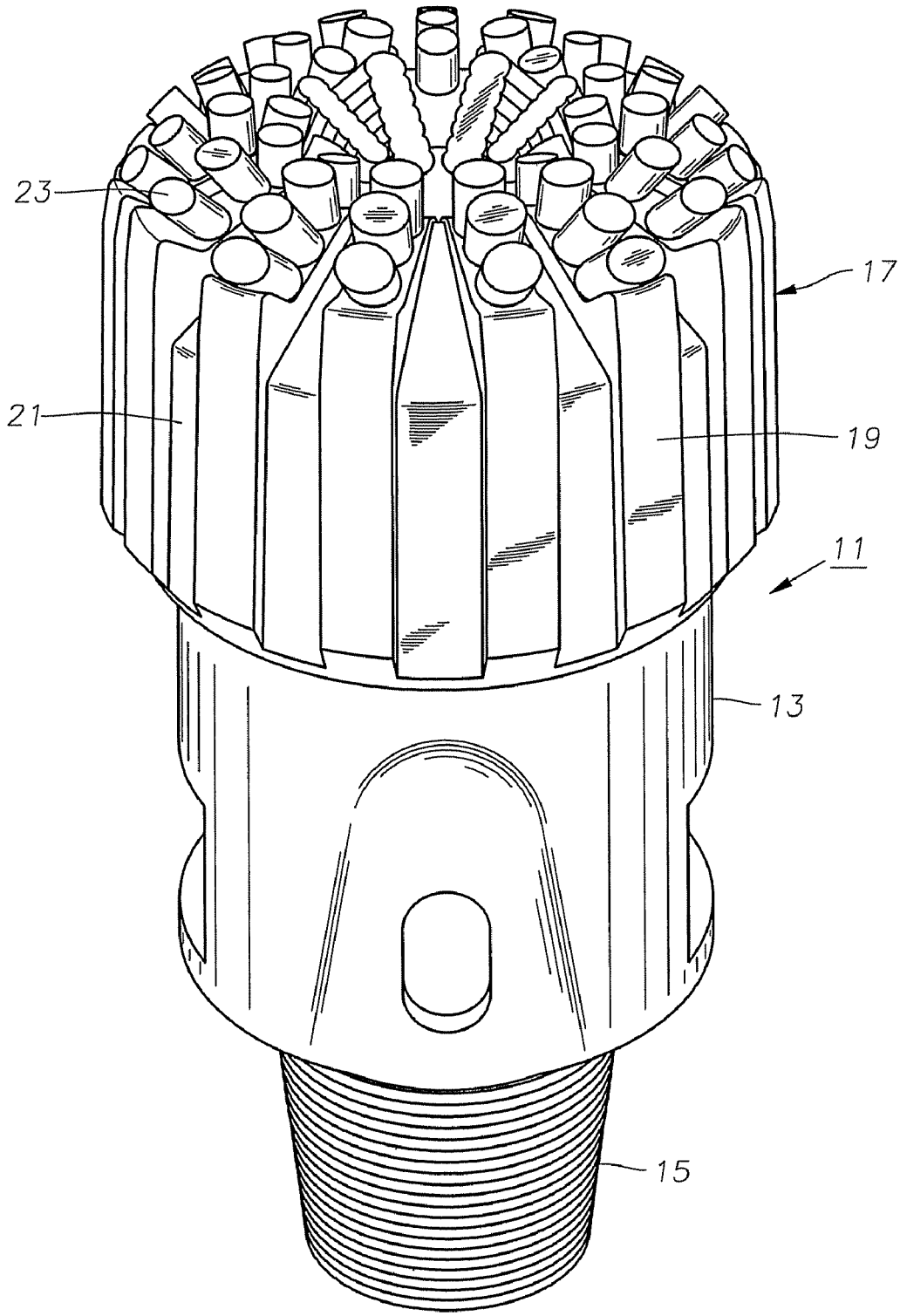
FIG. 1 is a perspective view of an earth boring bit constructed in accordance with the invention.

Referring to FIG. 1, bit 11 normally has a shank 13 of steel with threads 15 formed on its end for attachment to a drill string. A diamond-impregnated crown 17 is formed on the end of shank 13 opposite threads 15. Crown 17 may have a variety of configurations. Generally, crown 17 will have a plurality of blades 19 formed therein, each blade extending along the cylindrical side of crown 17 and over to a central throat area on the bottom. Blades 19 are separated from each other by channels 21 for drilling fluid and cuttings return flow. In the embodiment of FIG. 1, the portion of blades 19 on the bottom of crown 17 are divided into segments or posts 23. Alternatively, crown 17 may have smooth, continuous blades 19 extending to a central nozzle area.

Figure 2:
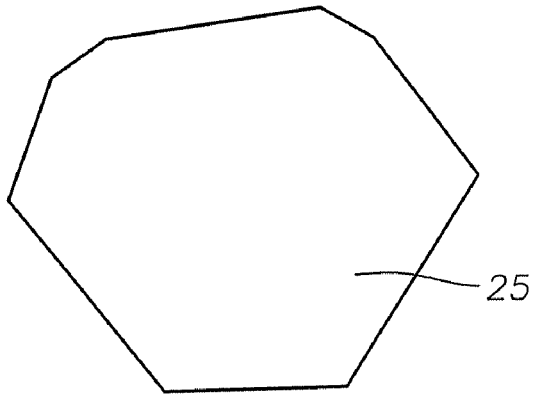
FIG. 2 is a schematic view of a diamond particle for impregnation into the crown of the drill bit of FIG. 1.

Referring to FIG. 2, the material of the cutting structure or blades 19 of crown 17 is impregnated with diamond grit or particles 25. Preferably, each diamond particle 25 comprises a single crystal in a cubic form, octahedral, or cuboctaliedral form having flat facets or sides. Diamonds 25 could be either natural or synthetic and may be of a conventional size for crown 17, which is typically about 25-35 mesh, or other ranges.

Figure 3:
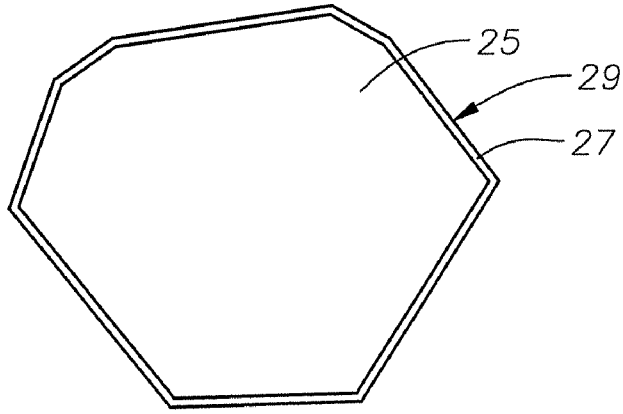
FIG. 3 is a schematic view of the diamond particle of FIG. 2, shown after being coated with tungsten.

Referring to FIG. 3, each diamond 25 is subsequently coated with tungsten to form a tungsten coating 27. Tungsten coating 27 is preferably formed by a conventional chemical vapor deposition (CVD) process. Tungsten coating 29 is a thin layer, being approximately 5 to 10 microns in thickness.

Figure 4:
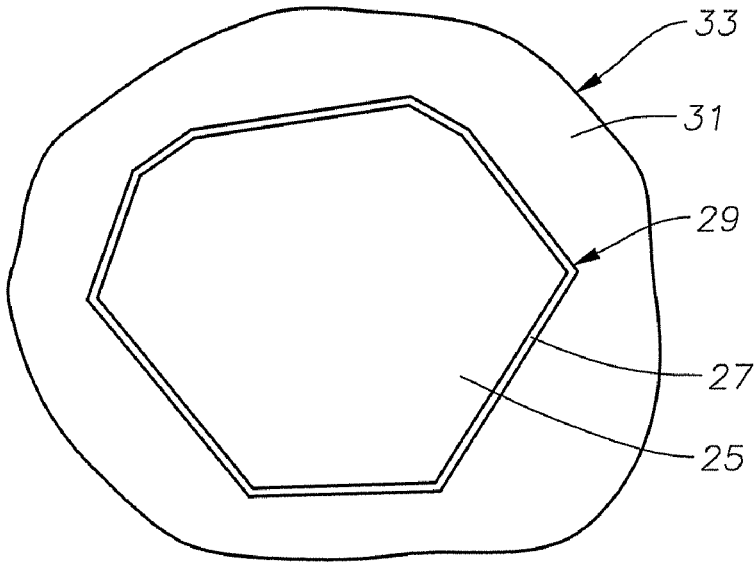
FIG. 4 is a schematic view of the coated diamond particle of FIG. 3, shown after being encased within encapsulation material.

The resulting coated diamond particle 29 then has an encapsulation layer 31 applied to it, as shown in FIG. 4. In the preferred embodiment, encapsulation layer 31 is applied by a mechanical process. Mechanical processes to encapsulate diamonds are known. One process typically includes mixing a carbide powder with an organic binder, extruding the mixture into short, cylindrical shapes which are then rolled into balls and dried. In one embodiment, the material of encapsulated layer 31 is selected from the group consisting essentially of tungsten carbide, titanium carbide and silicon carbide. Initially, there is no binder within encapsulation layer 31 to hold the carbide particles; rather the fine carbide powder is held around the coated diamond particle 29 by the green organic binder. The grains of carbide powder are much smaller than diamond crystal 25; for example the carbide powder might be in the range from 1 to 10 microns in diameter. The resulting encapsulated granule 33 is generally spherical and has a diameter that may vary upon application, but would typically be in the range from 100 to 1000 microns.

Figure 5:
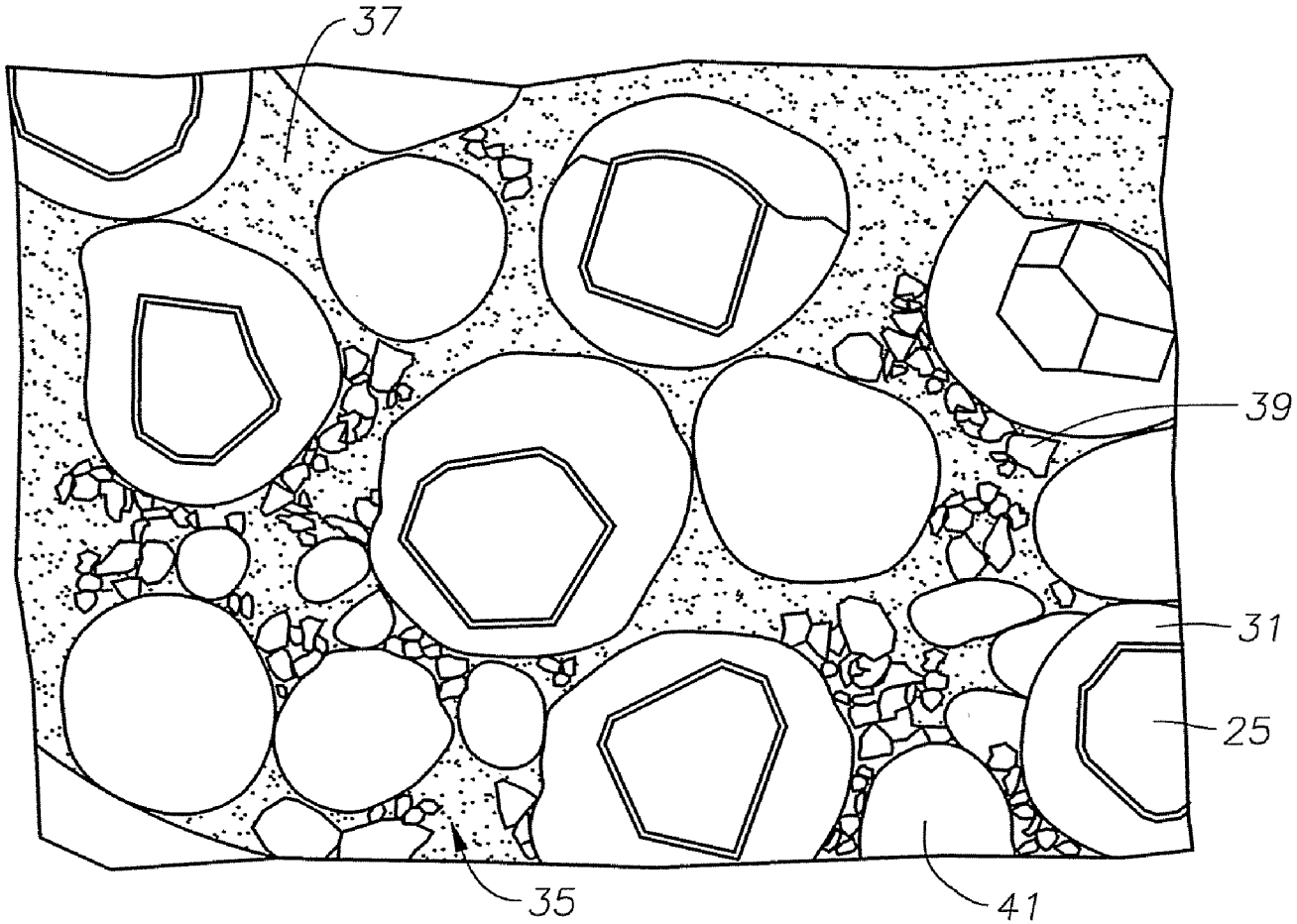
FIG. 5 is a drawing illustrating a photo micrograph of a cutting structure portion of the crown of the bit of FIG. 1, showing the encapsulated granules of FIG. 4 dispersed within the matrix material.

Encapsulated granules 33 are then mixed with a matrix material 35 (FIG. 5) and placed in portions of a mold shaped to define crown 17 (FIG. 1). To facilitate dispensing the mixture in the mold, the mixture may contain an adhesive so as to form a paste of the encapsulated granules 33 and matrix material 35. Matrix material 35 may be of the same type of material conventionally used to form diamond-impregnated bits. Matrix material 35 includes a metal binder 37, which is typically a copper alloy, such as copper-nickel or copper-manganese brasses or bronzes. Matrix material 35 may also include hard abrasive particles such as tungsten carbide, either sintered, cast or microcrystalline. The hard abrasive particles may have a variety of shapes, including spherical and irregular shapes. In the example of FIG. 5, the hard abrasive particles include crushed sintered tungsten carbide granules 39 as well as spherical cast tungsten carbide granules 41. The spherical granules 41 are larger in size than the crushed granules 39 in this example. Many variations are possible for the abrasive particles. The percentages of the hard abrasive particles in matrix material 35 relative to encapsulated diamond granules 33 may vary according to the application.

Normally, the encapsulated diamond granules 33 are placed only in the cutting structure part of the mold, which is the portion defining blades 19 (FIG. 1). The part of the mold corresponding to the remaining portion of crown 17 (FIG. 1) will contain only the matrix material 35. In some applications, the matrix material that is mixed with the encapsulated diamond granules 33 may differ from the matrix material that forms the non-cutting structure portions of crown 17 (FIG. 1). For example, the density of diamonds 25 (FIG. 2) may be sufficient so that the matrix material with which it is mixed does not need to have any additional abrasive particles, such as tungsten carbide. In that case, the matrix material mixed with encapsulated diamond granules 33 would have only the matrix binder metal 37. The matrix material for the non-cutting structure portions of crown 17 would have the matrix binder metal 37 and abrasive hard particles, such as tungsten carbide granules 37, 39.

The mold may have a fixture that holds bit shank 13 (FIG. 1) in contact with the matrix material 35. The mold, along with shank 13, matrix material 35 and encapsulated diamond granules 33, is placed in a furnace where it is heated at atmospheric pressure. The time and temperature are selected to cause matrix binder 37 to melt and flow down around the encapsulated granules 33 and hard abrasive particles 39 and 41. Binder metal 37 will infiltrate into encapsulated layer 31 (FIG. 4) and come into contact with tungsten coating 27, which prevents contact of the binder with diamond crystal 25. Even though binder metal 37 infiltrates encapsulated layer 31, the overall shape of each encapsulated diamond granule 33 remains substantially the same. The green binder that originally held the carbide powder of encapsulation layer 31 and any adhesive employed to form a paste will dissipate. The temperature is typically about 1,800 to 2,100° F. The time to cause thorough infiltration varies, but is approximately 1½ to 3 hours.

Subsequently, after cooling, crown 17 (FIG. 1) will be bonded to shank 13 and blades 19 will appear under magnification as shown in FIG. 5. The binder metal 37 that infiltrated encapsulation layer 31 (FIG. 4) serves as a binder for bonding the carbide powder of encapsulated layer 31 around diamond crystal 25. Binder metal 37 also bonds the encapsulated granules 33 and abrasive particles, if used, within the cutting structure. The encapsulated granules 33 remain discrete, as shown in FIG. 5, and at substantially the same size and shape as they had before heating. Encapsulated granules 33 provide a desired standoff or spacing between the individual diamond crystals 25 (FIG. 4). The tungsten coating 27 avoids direct contact of the matrix binder 37 with diamond crystals 25.

During operation, as bit 11 is rotated, blades 19 engage the earth formation to abrade the formation to form the borehole. The matrix material 35 will wear, eventually causing some of the encapsulated diamond granules 33 to loosen and break away from crown 17. However, this wearing process exposes further encapsulated granules 33 below the surface for continued drilling.

The encapsulated diamond grit 53 can be processed in a variety of diameters based on how much encapsulating material is added. The thickness of encapsulation layer 31 will drive the percentage of diamond volume or concentration in the resulting impregnated material. A thinner encapsulation layer 31 results in a higher diamond concentration in the product, and vice-versa, even if the diamond crystals 25 are approximately the same size. Grades or layers of different diameters of encapsulated granules 33 can be used in the same product. For example, crown 17 of bit 11 could have varying diamond concentrations across its profile or in a radial direction. By providing encapsulated granules 33 of different diameters, the diamond concentration could be varied in blades 19, such as from the front of the blade to the back.

The invention has significant advantages. Coating the diamond with multiple layers, one of which is a protective tungsten layer and the other a standoff layer, provides an effective means for forming a diamond-impregnated bit structure. The encapsulating layer provides the desired standoff while the tungsten layer provides resistance to attack on the diamond crystal by the binder in the matrix material. The invention provides enhanced diamond grit distribution, with greater, more consistent mean free paths. There is less localized balling on impregnated segments. The diamond grit has enhanced retention because the CVD process followed by a long cycle filtration process improves bonding. The wear properties can be customized or tailored to specific applications. The encapsulation and tungsten layers provide further protection from thermal damage. The ductility and wear resistance of the cutting structure of the bit can be varied by varying the thicknesses of the encapsulation layers.

While the invention has been described in only one of its forms, it should be apparent to those skilled in the art that it is not so limited, but is susceptible to various changes without departing from the scope of the invention.

The invention claimed is:

1. A method of constructing an earth boring diamond-impregnated cutting structure, comprising:

(a) coating diamond particles with tungsten, creating coated particles;

(b) applying to each of the coated particles an encapsulation layer of a carbide powder having no binder other than a green organic binder, creating encapsulated granules;

(c) placing the encapsulated granules with the green organic binder in a matrix binder material in a mold shaped to define a cutting structure; then (d) heating the encapsulated granules and the matrix binder material in the mold at atmospheric pressure for a time and temperature to cause the matrix binder material to melt and infiltrate into the encapsulation layers into contact with the coated particles; then (e) cooling the matrix binder material and the encapsulated granules, causing the matrix binder material to serve as a binder for the carbide powder to solidify and bond the encapsulated granules.

2. The method according to claim 1, wherein the green organic binder dissipates during step (d).

3. The method according to claim 1, wherein the matrix binder material of step (c) comprises a copper alloy.

4. The method according to claim 1, wherein the carbide powder comprises a material selected from the group consisting essentially of tungsten carbide, titanium carbide, and silicon carbide.

5. The method according to claim 1, wherein the carbide powder comprises grains of carbide powder having diameters much smaller than diameters of the diamond particles.

6. The method according to claim 1, wherein the matrix binder material is blocked from contact with the diamond particles by the tungsten coatings.

7. A method of constructing an earth boring diamond-impregnated cutting structure, comprising:

(a) coating diamond particles with tungsten by a chemical vapor deposition Process, creating coated particle;

(b) applying an encapsulation layer to each of the coated particles by mechanically attaching to the coated particles a powder made up of the material of the encapsulation layer and an organic green binder, creating encapsulated granules;

(c) placing the encapsulated granules and a matrix binder material in a mold shaped to define a cutting structure; then (d) heating the encapsulated granules and the matrix binder material in the mold at atmospheric pressure for a time and temperature to cause the matrix binder material to melt and infiltrate around the encapsulated granules; then (e) cooling the matrix binder material and the encapsulated granules, causing the matrix binder material to solidify and bond the encapsulated granules; and wherein step (c) further comprises mixing hard, abrasive matrix particles in the mold along with the encapsulated granules and the matrix binder material.

8. A method of constructing an earth boring diamond-impregnated drill bit, comprising:

(a) coating diamond particles with tungsten, creating coated particles;

(b) mechanically surrounding each of the coated particles with an encapsulation layer of a carbide powder held by an organic green binder material, creating encapsulated granules with a diameter in the range of 100 to 1000 microns, the carbide powder containing no binder other than the organic green binder material;

(c) placing the encapsulated granules along with the organic green binder material, a copper alloy matrix binder material and abrasive particles in a mold shaped to define a crown for the drill bit; then (d) heating the encapsulated granules, the matrix binder material, and the abrasive particles in the mold at atmospheric pressure for a time and temperature to dissipate the green binder material and to melt and infiltrate the matrix binder material into the encapsulating layers of the carbide powder of the encapsulated granules, forming a binder metal for the carbide powder, and around the abrasive particles; then (e) cooling the matrix binder material, the encapsulated granules and the abrasive particles.

9. The method according to claim 8, wherein step (a) is performed by is performed by a chemical vapor deposition process.

10. The method according to claim 8, wherein the carbide powder of the encapsulation layer comprises grains of carbide powder having diameters much smaller than diameters of the diamond particles.

11. The method according to claim 8, wherein the carbide powder of the encapsulation layer comprises a material selected from the group consisting essentially of tungsten carbide, titanium carbide, and silicon carbide.

12. The method according to claim 8, wherein the abrasive particles of step (c) comprise tungsten carbide particles.

13. The method according to claim 8, wherein the encapsulation layers remain discrete after step (d).

* * * * *